US012398609B2

(12) United States Patent
Allen

(10) Patent No.: US 12,398,609 B2
(45) Date of Patent: Aug. 26, 2025

(54) HANGER ASSEMBLY WITH ALIGNMENT/ANTI-ROTATION SYSTEM

(71) Applicant: Universal Wellhead Services Holdings, LLC, Corpus Christi, TX (US)

(72) Inventor: Jack Allen, Porter, TX (US)

(73) Assignee: Universal Wellhead Services Holdings, LLC, Corpus Christi, TX (US)

( * ) Notice: Subject to any disclaimer, the term of this patent is extended or adjusted under 35 U.S.C. 154(b) by 125 days.

(21) Appl. No.: 18/454,572

(22) Filed: Aug. 23, 2023

(65) Prior Publication Data

US 2024/0068318 A1 Feb. 29, 2024

Related U.S. Application Data

(60) Provisional application No. 63/401,777, filed on Aug. 29, 2022.

(51) Int. Cl.
*E21B 33/04* (2006.01)

(52) U.S. Cl.
CPC ..... *E21B 33/04* (2013.01)

(58) Field of Classification Search
CPC ..... E21B 33/04
See application file for complete search history.

(56) References Cited

U.S. PATENT DOCUMENTS

| | | | | |
|---|---|---|---|---|
| 10,246,964 | B2 * | 4/2019 | Kam | E21B 33/04 |
| 11,661,807 | B1 * | 5/2023 | Soh | E21B 33/04 166/382 |
| 2008/0230229 | A1 * | 9/2008 | Shaw | E21B 33/035 166/344 |
| 2012/0125634 | A1 * | 5/2012 | Guitierrez | E21B 33/04 166/77.51 |
| 2017/0167217 | A1 * | 6/2017 | Kam | E21B 33/04 |

* cited by examiner

*Primary Examiner* — Yanick A Akaragwe
(74) *Attorney, Agent, or Firm* — Ted M. Anthony

(57) ABSTRACT

A hanger assembly has at least one elongated channel disposed on the outer surface of the hanger assembly. An alignment/anti-rotation tab member is moveably disposed within each elongated channel and can selectively alternate between a first retracted configuration and a second extended configuration. In the second extended configuration, each alignment/anti-rotation tab member can be received within a mating channel along the inner surface of the central through bore of the wellhead. Each extended alignment/anti-rotation tab member can engage against a mating recess or channel in order to align and orient the hanger assembly within the central through bore of the wellhead (permitting orientation and alignment of ports in the hanger assembly and the surrounding wellhead), while also preventing rotation of the hanger assembly relative to the wellhead.

15 Claims, 12 Drawing Sheets

HANGER ASSEMBLY WITH ALIGNMENT/ANTI-ROTATION SYSTEM

CROSS REFERENCES TO RELATED APPLICATION

THIS APPLICATION CLAIMS PRIORITY OF U.S. PROVISIONAL PATENT APPLICATION Ser. No. 63/401,777, FILED Aug. 29, 2022, INCORPORATED BY REFERENCE HEREIN.

STATEMENTS AS TO THE RIGHTS TO THE INVENTION MADE UNDER FEDERALLY SPONSORED RESEARCH AND DEVELOPMENT

NONE

BACKGROUND OF THE INVENTION

1. Field of the Invention

The present invention pertains to a hanger assembly for use in oil and gas wells. More particularly, the present invention pertains to a hanger assembly having at least one alignment and/or anti-rotation member. More particularly still, the present invention pertains to a hanger assembly having at least one alignment or anti-rotation member that selectively provides specific orientation, and prevents rotation, of said hanger assembly relative to a mating wellhead.

2. Description of Related Art

During the drilling of oil and/or gas wells, wellhead systems are usually installed at or near the earth's surface. Such wellhead systems are typically assembled as the drilling process proceeds. Generally, wellhead systems typically comprise a starting casing head, at least one intermediate casing wellhead and, ultimately, a tubing wellhead.

A casing hanger, which is a device attached to the uppermost casing joint in a well, is typically received or "landed" within a casing wellhead to support a casing string. Similarly, a tubing hanger is a device attached to the uppermost joint of production tubing in in a well; the tubing hanger is received or "landed" within a tubing wellhead to support the tubing string.

Both hangers and mating wellheads (casing heads or tubing heads) frequently incorporate some type of sealing system to ensure that the central bore of a pipe string is hydraulically isolated from its annulus. Further, hangers often include at least one port to permit the communication of hydraulic fluid, electrical signal(s), chemical injection and/or other substances into said hanger via said port(s). Similarly, mating wellheads (casing heads or tubing heads) also frequently include at least one port to allow for many of the same functions and/or benefits as the port(s) in said hanger. Ideally, the port(s) in a hanger should be aligned with the port(s) in a surrounding wellhead.

Conventional hangers do not provide a means for orienting and aligning said port(s) in said hangers with port(s) in a surrounding wellhead in order to allow unrestricted flow through said aligned port(s). Additionally, conventional hangers also do provide a means for preventing the hanger from rotating within a wellhead, which can cause said hanger port(s) to become misaligned with wellhead port(s).

The misalignment of port(s) between the hanger and wellhead can negatively impact functional operation of the equipment. Further, such misalignment can cause the hanger and wellhead to experience erosion from fluid flow, which can cause damage that can necessitate the costly removal, repair and/or replacement of the hanger and/or wellhead.

Thus, there is a need for an efficient and effective system for aligning the port(s) in a hanger with port(s) in a surrounding wellhead. The system should further prevent a hanger from rotating within a wellhead and thereby causing said hanger port(s) to become misaligned with port(s) in said wellhead. Further, the system should be cost-effective and easy to manufacture and operate.

SUMMARY OF THE INVENTION

In a preferred embodiment, the present invention comprises a hanger assembly for use within a mating wellhead. Said hanger assembly includes a mechanism for aligning port(s) in said hanger with port(s) in said surrounding wellhead. The present invention further prevents said hanger from rotating within a surrounding wellhead which can cause said hanger port(s) to become misaligned with port(s) in said wellhead.

A hanger assembly is configured to be received within the central through bore of a wellhead. Said hanger assembly can be disposed at the upper end of a string of casing, tubing or other pipe which can be "hung" or "landed" within said wellhead. At least one downwardly-facing shoulder is disposed on the outer surface of said hanger assembly and can cooperate with an opposing upwardly-facing shoulder disposed on the inner surface of said central through bore of said wellhead. Said opposing shoulders cooperate to support said hanger assembly and any attached pipe string.

In a preferred embodiment, the hanger assembly and wellhead of the present invention further comprise at least one alignment/anti-rotation tab system. Said hanger assembly has a central through-bore, and at least one elongated channel is disposed on the outer surface of said hanger assembly. Said elongated channel is oriented substantially parallel to the longitudinal axis of said central through bore. An alignment/anti-rotation tab member is moveably disposed within each such channel. Said alignment/anti-rotation tab member can selectively alternate between a first retracted configuration, and a second extended configuration.

When in said extended configuration, said alignment/anti-rotation tab member can be received within a mating recess or channel disposed along the inner surface of the central through bore of said wellhead. Said extended alignment/anti-rotation tab member can engage against said mating recess or channel in order to align said hanger assembly within said central through bore of said wellhead. Further, said extended alignment/anti-rotation tab member can engage against said mating recess or channel to prevent relative rotation of said hanger assembly within said central through bore of said wellhead.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

Further, the drawings constitute a part of this specification and include exemplary embodiments of the technology. It is to be understood that in some instances, various aspects of the invention may be shown exaggerated or enlarged to facilitate an understanding of the invention. Therefore, the drawings may not be to scale.

DETAILED DESCRIPTION OF A PREFERRED EMBODIMENT OF THE INVENTION

Figure 1:
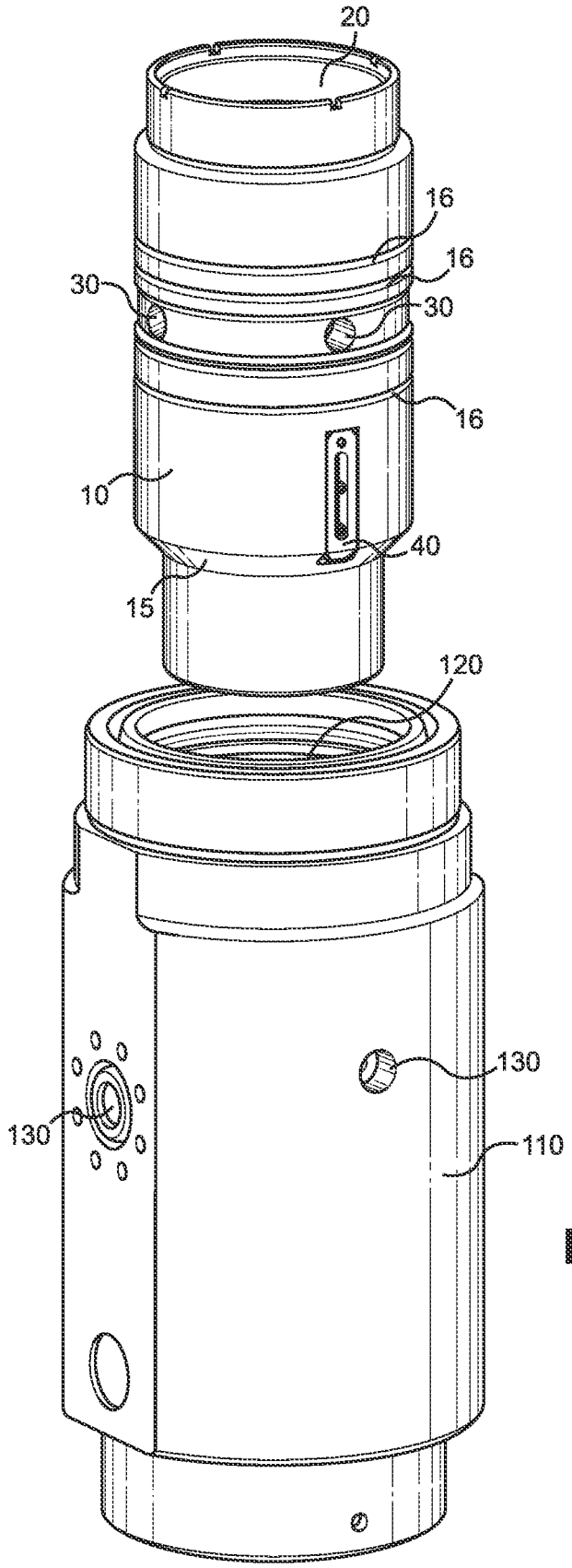
FIG. 1 depicts a side perspective view of a hanger assembly comprising an alignment/anti-rotation member and mating wellhead assembly of the present invention.

Before describing various embodiments of the present disclosure in further detail by way of exemplary description, examples, and results, it is to be understood that the apparatus and methods of the present disclosure are not limited in application to the details of specific embodiments and examples as set forth in the following description. The description provided herein is intended for purposes of illustration only and is not intended to be construed in a limiting sense. As such, the language used herein is intended to be given the broadest possible scope and meaning, and the embodiments and examples are meant to be exemplary, not exhaustive. Also, it is to be understood that the phraseology and terminology employed herein is for the purpose of description only and should not be regarded as limiting unless otherwise indicated as so. Moreover, in the following detailed description, numerous specific details are set forth in order to provide a more thorough understanding of the present disclosure.

It will be apparent to a person having ordinary skill in the art that the present disclosure may be practiced without these specific details. In other instances, features which are well known to persons of ordinary skill in the art have not been described in detail to avoid unnecessary complication of the description. It is intended that all alternatives, substitutions, modifications, and equivalents apparent to those having ordinary skill in the art are included within the scope of the present disclosure. Thus, while the apparatus and methods of the present disclosure have been described in terms of particular embodiments, it will be apparent to those of skill in the art that variations may be applied to the apparatus and methods and the steps or in the sequence of steps of the methods described herein without departing from the concept, spirit, and scope of the inventive concepts. Referring to the drawings, like numerals indicate like or corresponding parts throughout the several views.

FIG. 1 depicts a side perspective view of a wellhead 110 and hanger assembly 10 of the present invention. Said hanger assembly 10 and mating wellhead 110 are equipped with an alignment/anti-rotation system of the present invention. Hanger assembly 10 has central through bore 20, while wellhead assembly 110 has central through bore 120. Although not depicted in FIG. 1, it is to be observed that hanger assembly 10 can be attached at the upper extent of a length of pipe, such as a casing string or other tubular string, being run in a well. Said hanger assembly 10, with a length of pipe attached, can be received or "landed" within central through bore 120 of wellhead 110 in order to support said pipe string.

In the embodiment depicted in FIG. 1, hanger assembly 10 further comprises alignment/anti-rotation tab member 40 disposed on the outer surface of said hanger assembly 10. Additionally, said hanger assembly 10 further generally comprises landing shoulder 15 which engages with an opposing shoulder (not visible in FIG. 1) disposed on the inner surface of central through bore 120 of wellhead 110. A plurality of transverse ports 30 extend through hanger assembly 10 from the external surface of said hanger assembly to central through bore 20; when said hanger assembly 10 is fully received and landed within central through bore 120 of wellhead 110, said transverse ports 30 can be aligned with transverse ports 130 extending through wellhead 110.

A plurality of grooves 16 for receiving sealing members, such as O-rings or other elastomeric sealing elements, are disposed along the outer surface of said hanger assembly 10. When said hanger assembly 10 is fully received and landed within central through bore 120 of wellhead 110, said O-rings or other sealing members disposed in grooves 16 can engage against the inner surface of said central through bore 120 of wellhead 110 to form a fluid pressure seal between said hanger assembly 10 and said wellhead 110.

Figure 2:
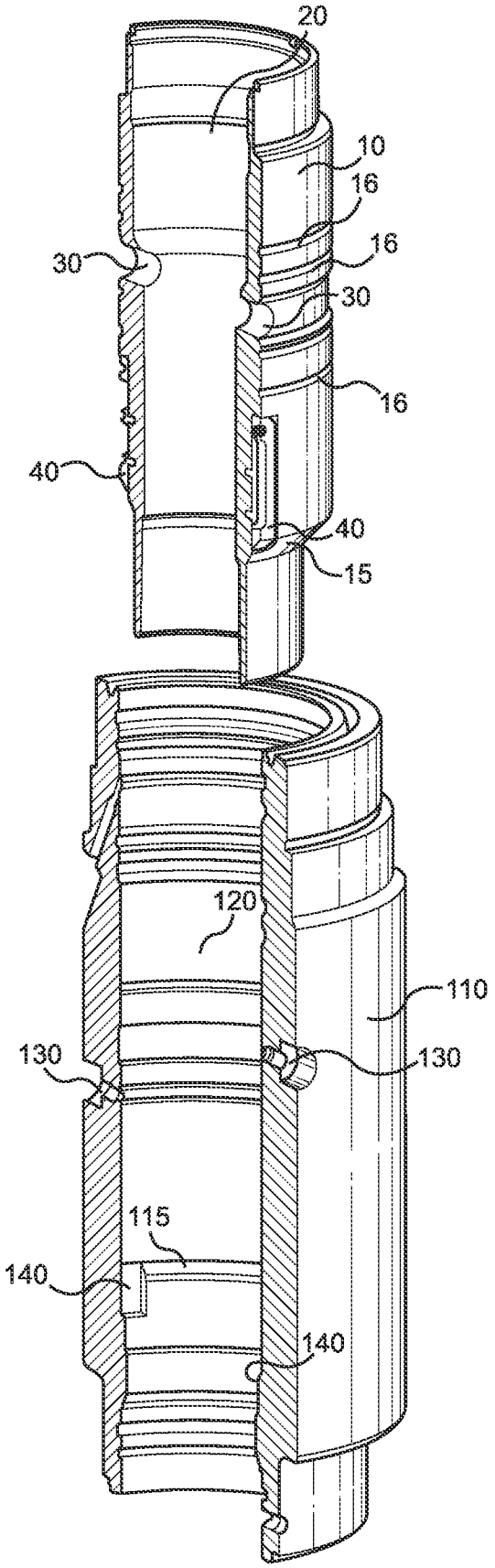
FIG. 2 depicts a side perspective cut-away view of a hanger assembly having an alignment/anti-rotation member and mating wellhead assembly of the present invention.

FIG. 2 depicts a side perspective and partial cut-away view of a wellhead 110 and hanger assembly 10 of the present invention. Hanger assembly 10 has central through bore 20, while wellhead assembly 110 has central through bore 120. Hanger assembly 10 has downwardly-facing landing shoulder 15 that can engage against opposing upwardly-facing shoulder 115 which is disposed on the inner surface of central through bore 120 of wellhead 110. Said landing shoulder 15 and opposing shoulder 115 cooperate to support hanger assembly 10 and any attached pipe string when said hanger assembly 10 is landed within central through bore 120 of wellhead 110.

A plurality of transverse ports 30 extend through hanger assembly 10 from the external surface of said hanger assembly to central through bore 20. A plurality of transverse ports 130 also extend through wellhead 110 from the external surface of said wellhead 110 to said central through bore 120. Said ports 30 of hanger 10 can be aligned with transverse ports 130 extending through wellhead 110 when hanger assembly 10 is fully received and landed (and properly aligned and oriented) within central through bore 120 of wellhead 110. Grooves 16 are disposed along the outer surface of hanger assembly 10 for receiving O-rings or other elastomeric sealing members. Said sealing members disposed within grooves 16 can engage against the inner surface of said central through bore 120 of wellhead 110 to form a fluid pressure seal between said hanger assembly 10 and said wellhead 110 when said hanger assembly 10 is landed within wellhead 110.

Alignment/anti-rotation tab members 40 are disposed on the outer surface of said hanger assembly 10. Slots 140 are disposed on the inner surface of central through bore 120 of wellhead 110. When hanger assembly 10 is fully received and landed within central through bore 120 of wellhead 110, alignment/anti-rotation tab members 40 of said hanger assembly 10 are generally aligned with said slots 140 formed on the inner surface of central through bore 120 of wellhead 110.

Figure 3:
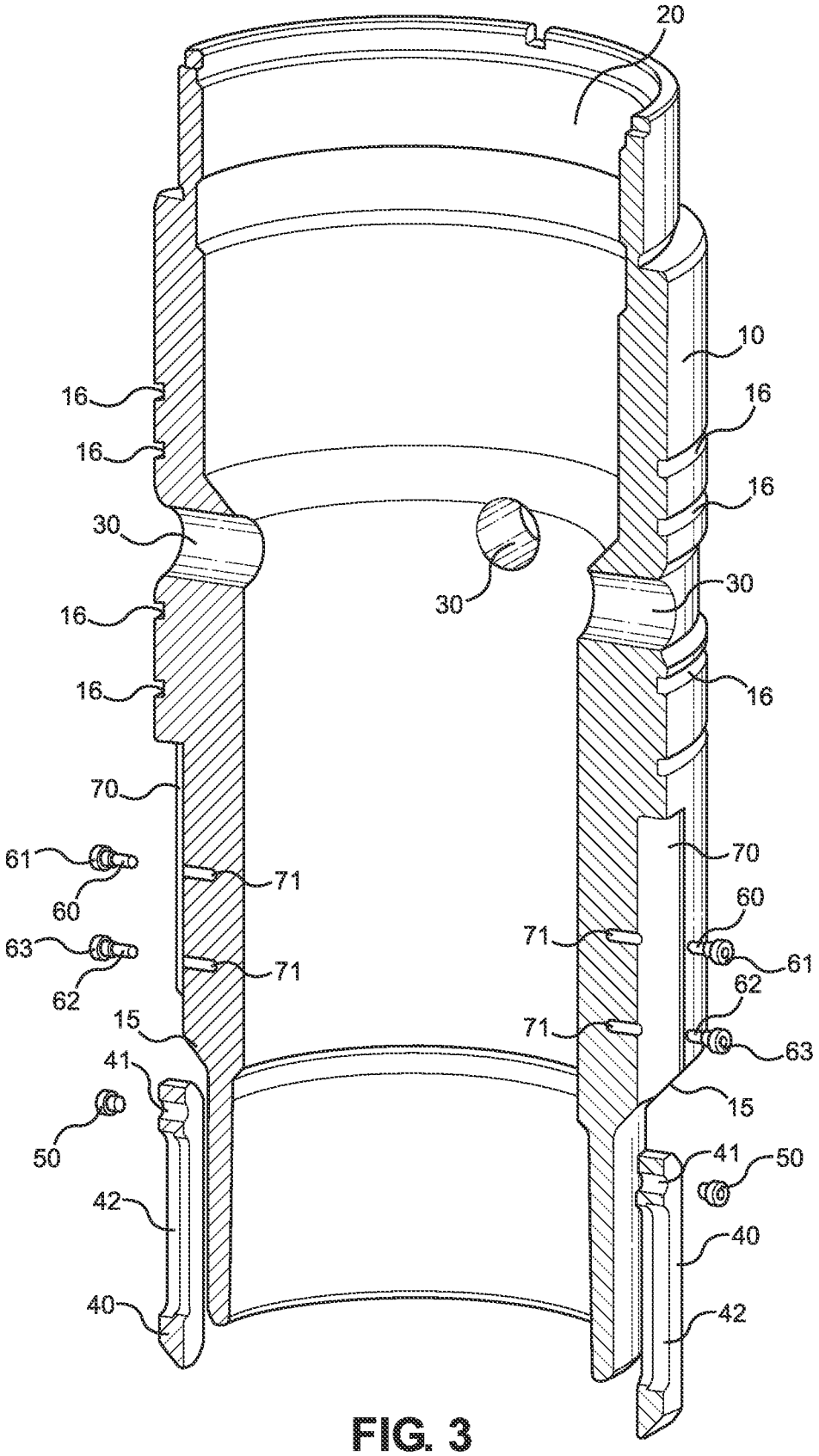
FIG. 3 depicts a side perspective cut-away and partially exploded view of a hanger assembly of the present invention having a plurality of alignment/anti-rotation tab members.
Figure 4:
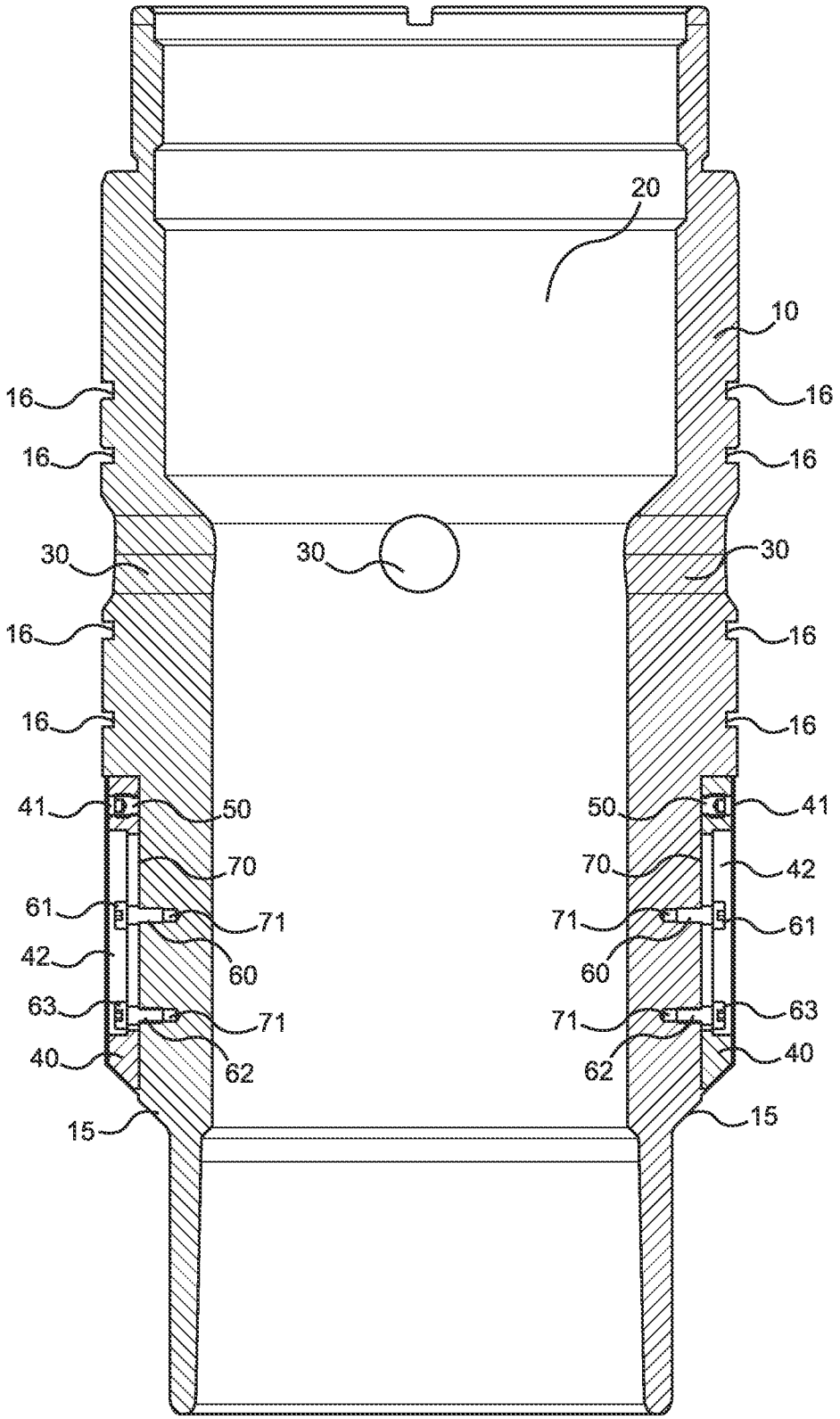
FIG. 4 depicts a side sectional view of a hanger assembly of the present invention having a plurality of alignment/anti-rotation tab members in a retracted configuration (such as, for example, for shipment).

FIG. 3 depicts a side perspective cut-away and partially exploded view of a hanger assembly 10 of the present invention, while FIG. 4 depicts a side sectional view of said hanger assembly 10. Referring to FIGS. 3 and 4, hanger assembly 10 has central through bore 20. A plurality of transverse ports 30 extend through hanger assembly 10 from the external surface of said hanger assembly 10 to central through bore 20. Grooves 16 are disposed along the outer surface of hanger assembly 10 for receiving O-rings or other elastomeric sealing members.

In a preferred embodiment, elongated recesses 70 are disposed along the exterior surface of hanger assembly 10 and are generally oriented parallel to the longitudinal axis of central through bore 20. Alignment/anti-rotation tab members 40 are moveably disposed within said elongated recesses 70. Alignment/anti-rotation tab members 40 each have an elongated slot 42 and transverse bore 41. Alignment bolts 60, each having head 61, and alignment bolts 62, each having head 63, are disposed through said elongated slot 42 of each alignment/anti-rotation tab member 40. Further, said alignment bolts 60 and 61 can be partially received within threaded bores 71 in elongated recesses 70 of hanger assembly 10. A set screw 50 is received within each transverse bore 41 of each alignment/anti-rotation tab member 40.

When said set screws 50 are sufficiently loosened, it is to be observed that said alignment/anti-rotation tab members 40 can slidably move within said elongated recesses 70; said movement can be in the direction of the longitudinal axis of each of said elongated recess 70. In the embodiment depicted in FIG. 4, alignment/anti-rotation tab members 40 are in a retracted position within elongated recesses 70 in hanger assembly 10. It is to be observed that set screws 50 can be tightened in order to "lock" said alignment/anti-rotation tab members 40 in this position. In the configuration depicted in FIG. 4, said alignment/anti-rotation tab members 40 do not extend beyond downwardly-facing landing shoulder 15 of hanger assembly 10.

Figure 5:
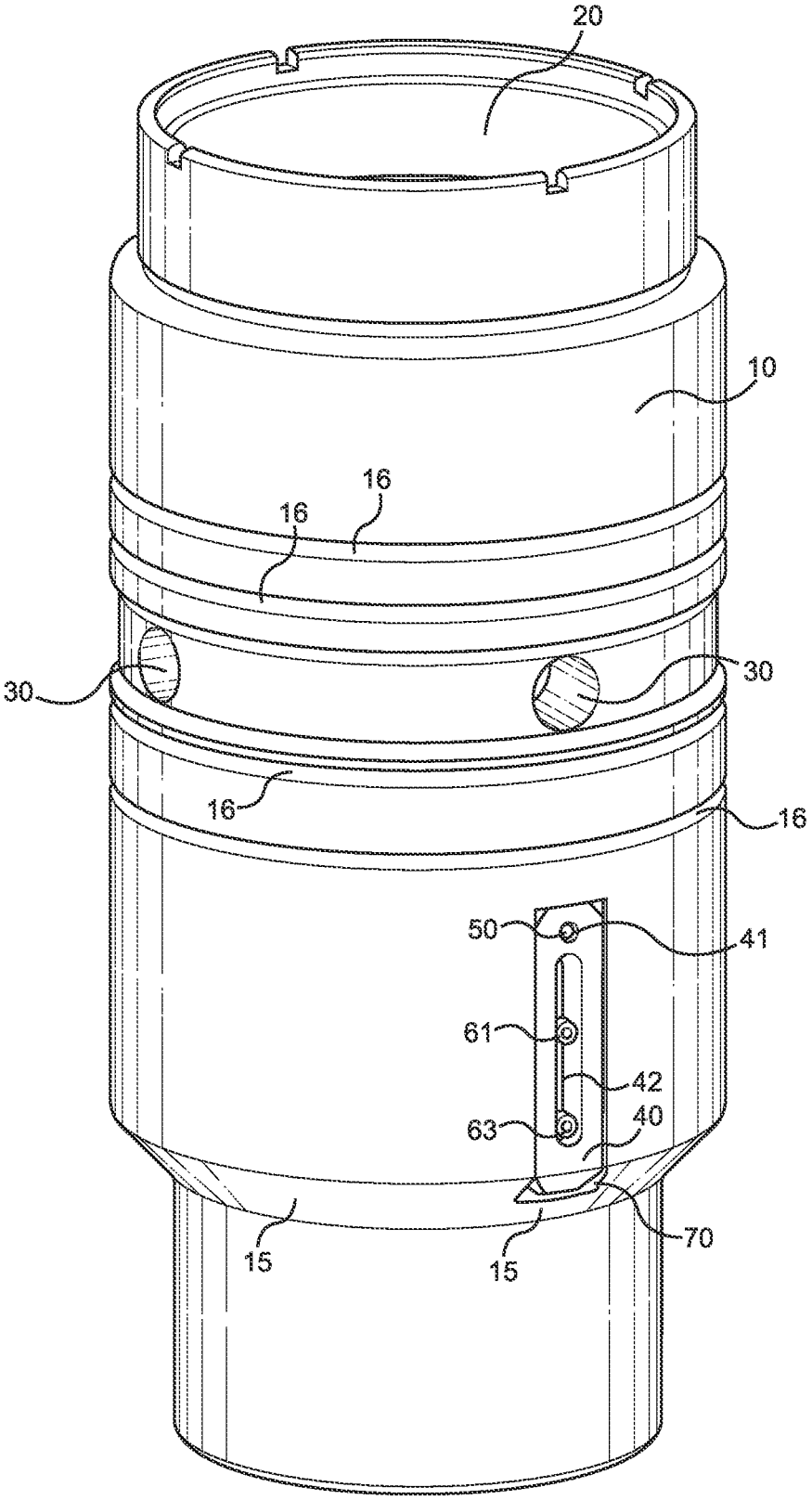
FIG. 5 depicts a side perspective view of a hanger assembly of the present invention having an alignment/anti-rotation tab member in a retracted configuration (such as, for example, for shipment).

FIG. 5 depicts a side perspective view of a hanger assembly 10 of the present invention. Hanger assembly 10 has central through bore 20 extending through said hanger assembly 10. A plurality of transverse ports 30 extend through hanger assembly 10 from the external surface of said hanger assembly 10 to central through bore 20. A plurality of circumferential grooves 16 are disposed along the outer surface of hanger assembly 10 for receiving O-rings or other elastomeric sealing members (not depicted in FIG. 5). Elongated recess 70 is disposed along the exterior surface of hanger assembly 10, while alignment/anti-rotation tab member 40 is moveably disposed within said elongated recess 70.

Said alignment/anti-rotation tab member 40 has elongated slot 42 and transverse bore 41. Alignment bolt 60 (not visible in FIG. 5) having head 61 and alignment bolt 62 (not visible in FIG. 5) having head 63 are disposed through said elongated slot 42 and threadedly connected to hanger assembly 10. Set screw 50 is received within transverse bore 41 of alignment/anti-rotation tab member 40. It is to be observed that said alignment/anti-rotation tab member 40 can move within said elongated recess 70 when said set screw 50 is sufficiently loosened and does not frictionally or mechanically lock said alignment/anti-rotation tab member 40 against movement. Such movement of said alignment/anti-rotation tab member 40 is in the direction of the longitudinal axis of said elongated recess 70, which is generally parallel to the longitudinal axis of central through bore 20. When in a retracted position within elongated recess 70, said alignment/anti-rotation tab member 40 does not extend beyond downwardly-facing landing shoulder 15 of hanger assembly 10.

Figure 6:
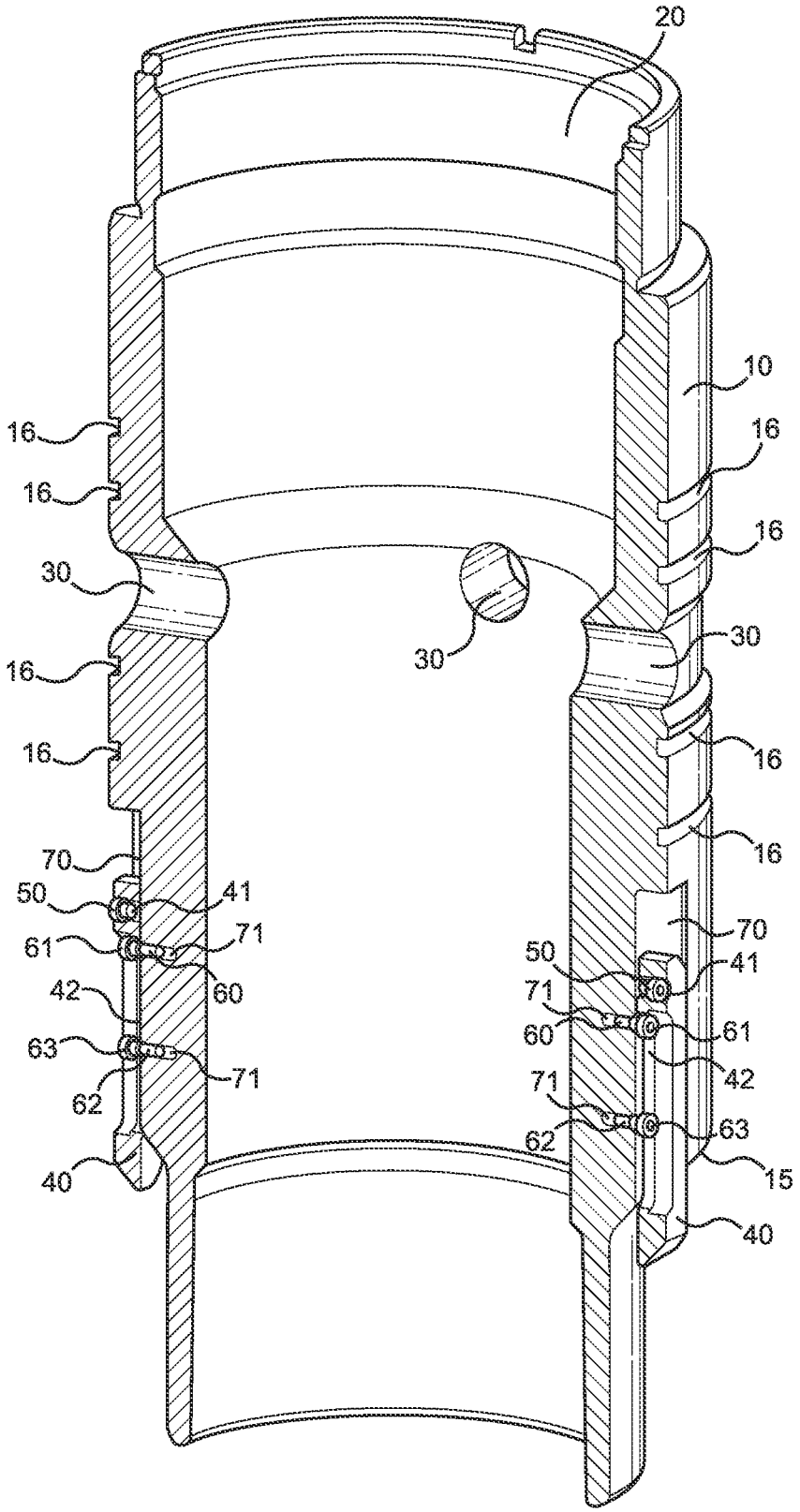
FIG. 6 depicts a side perspective and cut away view of a hanger assembly of the present invention having a plurality of alignment/anti-rotation tab members in an extended configuration.
Figure 7:
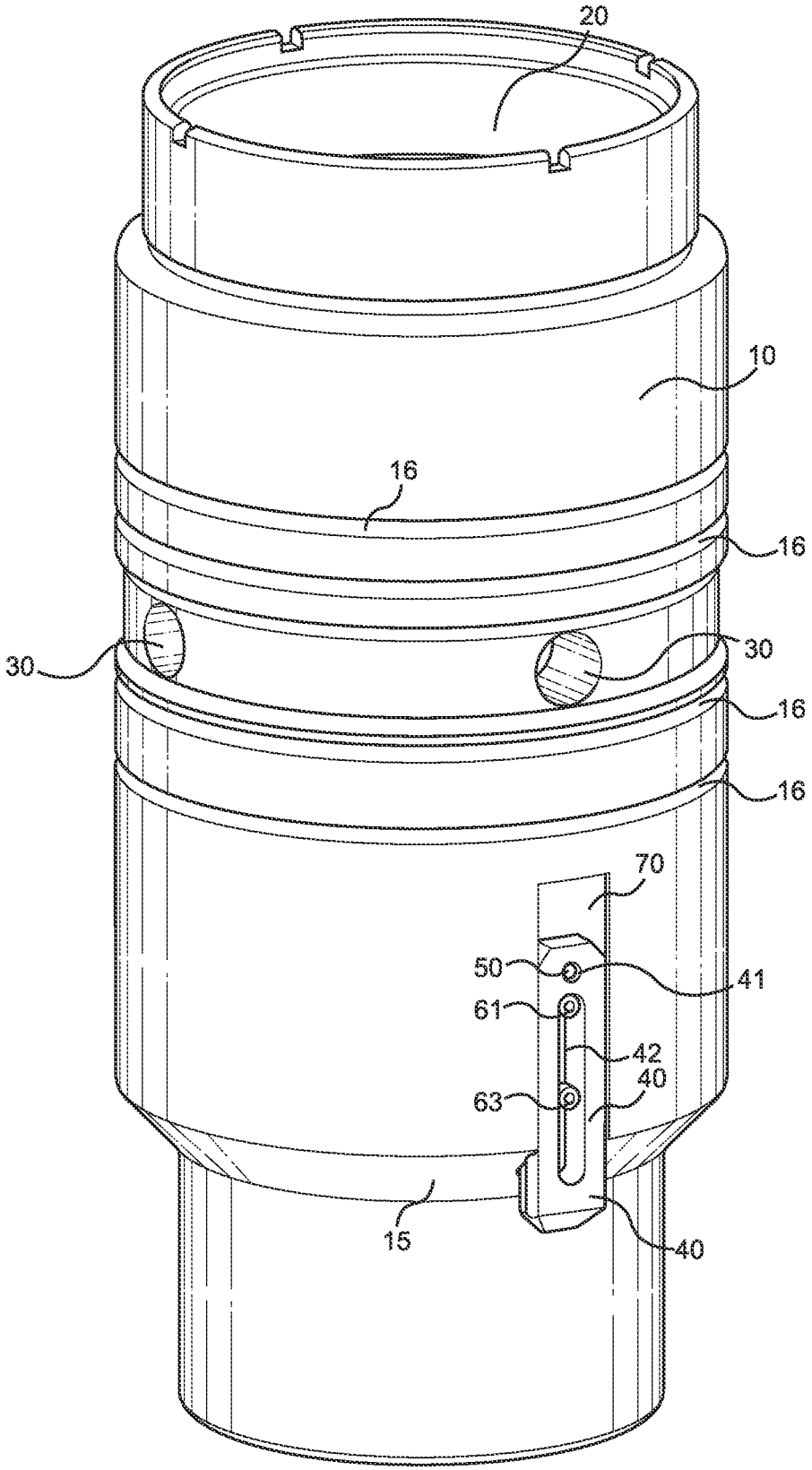
FIG. 7 depicts a side perspective view of a hanger assembly of the present invention having an alignment/anti-rotation tab member in an extended configuration.

FIG. 6 depicts a side perspective and cut away view of a hanger assembly 10, while FIG. 7 depicts a side perspective view of said hanger assembly 10. As depicted in FIGS. 6 and 7, alignment/anti-rotation tab members 40 are in an extended configuration, wherein said alignment/anti-rotation tab members 40 at least partially extend past downwardly-facing support shoulder 15.

Referring to FIGS. 6 and 7, hanger assembly 10 has central through bore 20 extending through said hanger assembly 10. A plurality of transverse ports 30 extend through hanger assembly 10 from the external surface of said hanger assembly 10 to central through bore 20. A plurality of circumferential grooves 16 are disposed along the outer surface of hanger assembly 10 for receiving O-rings or other elastomeric sealing members.

Elongated recesses 70 are disposed along the exterior surface of hanger assembly 10, while an alignment/anti-rotation tab member 40 is moveably disposed within each of said elongated recess 70. As previously discussed, each alignment/anti-rotation tab member 40 has elongated slot 42 and transverse bore 41. Alignment bolt 60 having head 61, and alignment bolt 62 having head 63, are disposed through said elongated slots 42 and threadedly connected to hanger assembly 10 in threaded bores 71. Set screw 50 is received within each transverse bore 41 of each alignment/anti-rotation tab member 40.

It is to be observed that said alignment/anti-rotation tab members 40 can move within each elongated recess 70 when said set screws 50 are sufficiently loosened. Such movement of said alignment/anti-rotation tab member 40 is in the direction of the longitudinal axis of said elongated recess 70. When in extended position within elongated recess 70, said alignment/anti-rotation tab member 40 extends or protrudes beyond landing shoulder 15 of hanger 10. It is to be observed that alignment bolt 60 having head 61 disposed through said each elongated slot 42 limits downward travel of each alignment/anti-rotation tab member 40 within an elongated recess 70.

Figure 8:
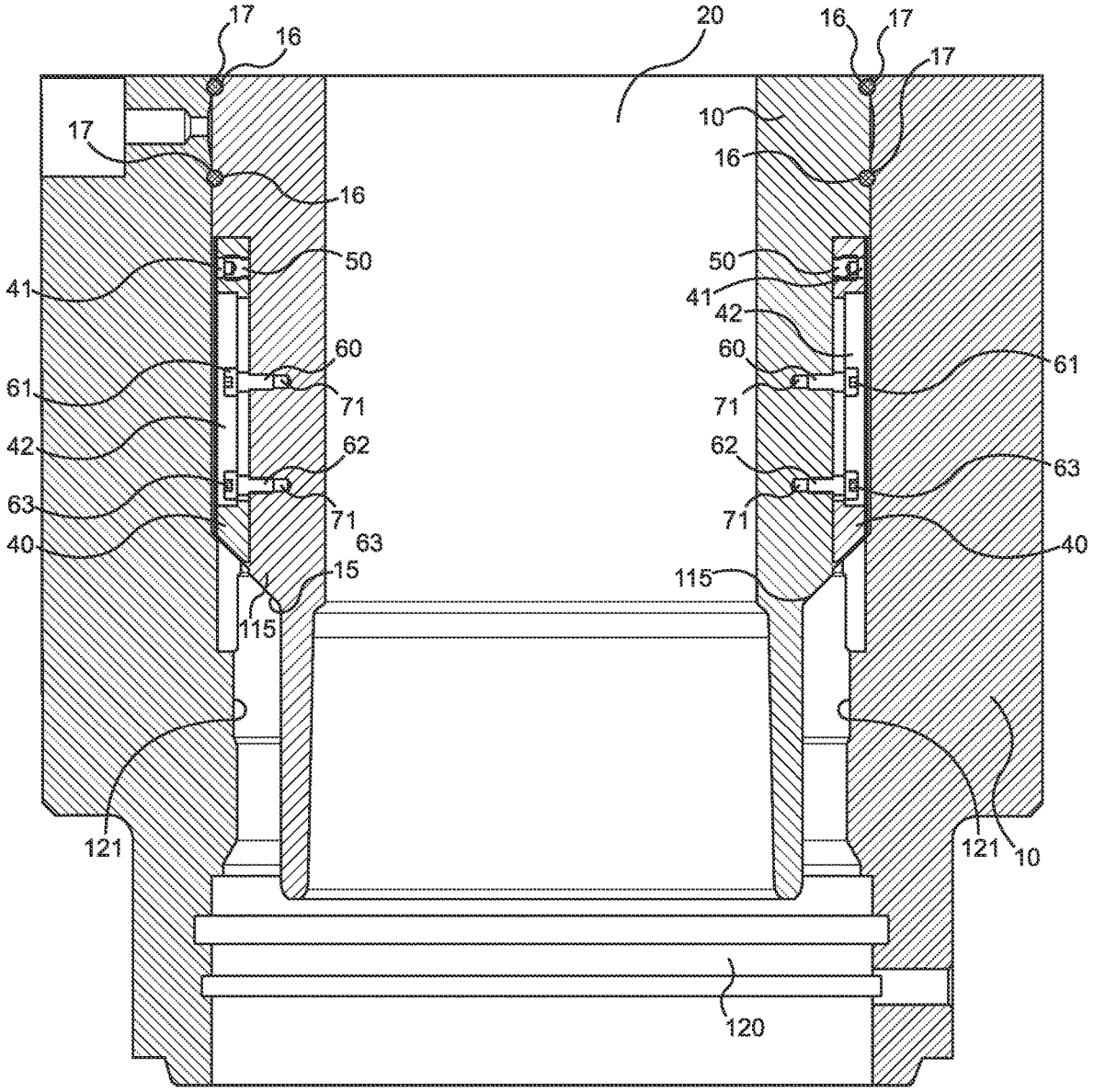
FIG. 8 depicts a side sectional view of a hanger assembly of the present invention within a wellhead with alignment/anti-rotation tab members in a retracted configuration.
Figure 9:
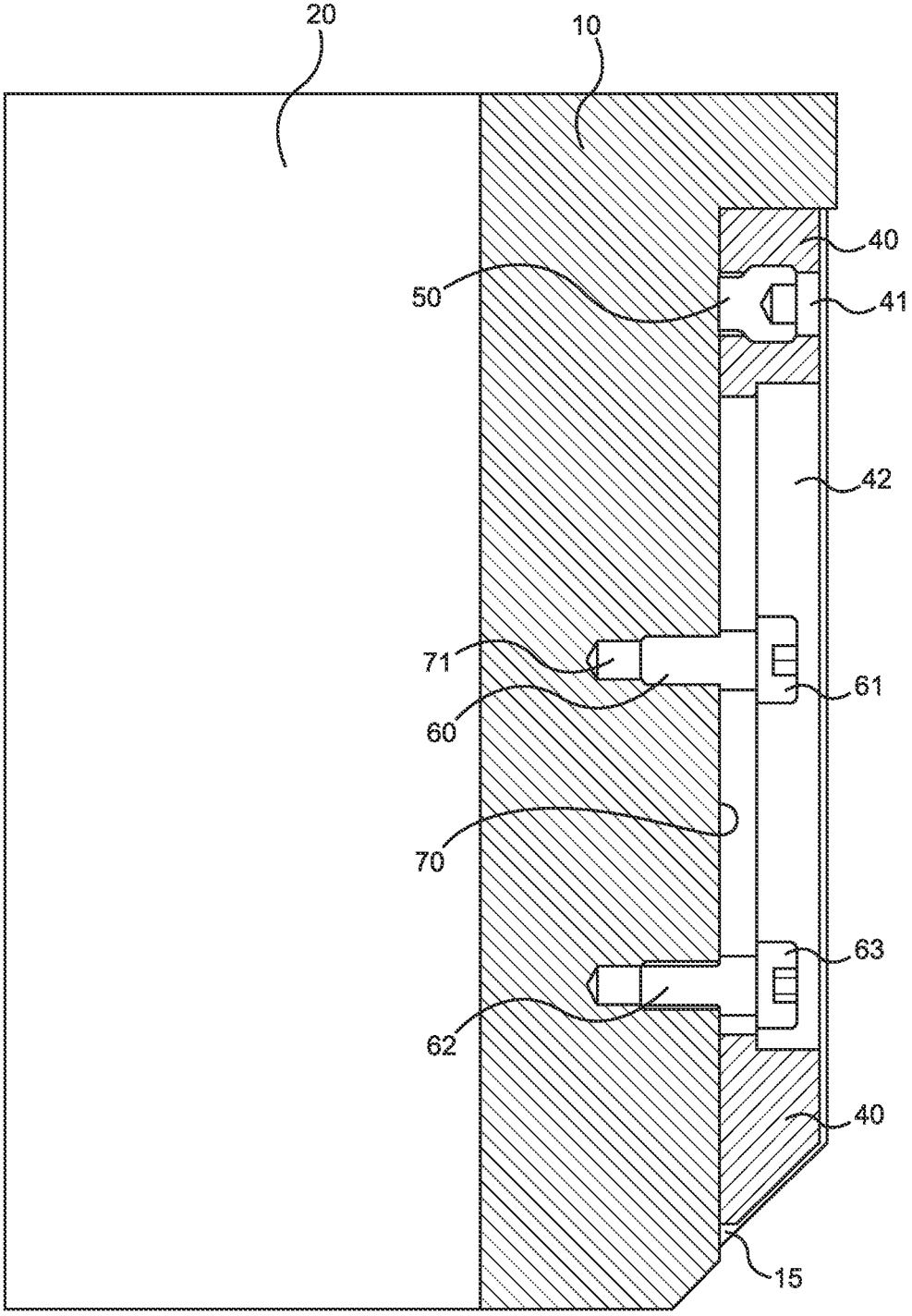
FIG. 9 depicts a side sectional and detailed view of an alignment/anti-rotation tab member in a retracted configuration.

FIG. 8 depicts a side sectional view of a hanger assembly 10 of the present invention installed within a central through bore 120 of a wellhead 110, while FIG. 9 depicts a detailed side sectional view of an alignment/anti-rotation tab member 40 of said hanger assembly 10 depicted in FIG. 8.

Referring to FIG. 8, hanger assembly 10 having central through bore 20 is received within central through bore 120 of wellhead 110. Hanger assembly 10 has downwardly-facing landing shoulder 15 that engages against opposing upwardly-facing shoulder 115 which is disposed on the inner surface of central through bore 120 of wellhead 110. Landing shoulder 15 and opposing shoulder 115 cooperate to support hanger assembly 10 (and any attached pipe string) when said hanger assembly 10 is landed within central through bore 120 of wellhead 110. Grooves 16 are disposed along the outer surface of hanger assembly 10 for receiving O-rings or other elastomeric sealing members 17. Said O-rings or other elastomeric sealing members 17 engage against inner surface 121 of central through bore 120 of wellhead 110 to form a fluid pressure seal between hanger assembly 10 and wellhead 110.

Each alignment/anti-rotation tab member 40 has elongated slot 42 and transverse bore 41. Alignment bolt 60 having head 61, and alignment bolt 62 having head 63, are disposed through said elongated slots 42 and threadedly connected to hanger assembly 10 in threaded bores 71. Set screw 50 is received within each transverse bore 41 of each alignment/anti-rotation tab member 40. In the configuration depicted in FIG. 8, said alignment/anti-rotation tab members 40 are aligned with slots 140 formed along the inner surface of central through bore 120 of wellhead 110. As depicted in FIG. 8, in a retracted position and said alignment/anti-rotation tab members 40 do not extend beyond downwardly-facing landing shoulder 15 and are not received within said slots 140.

Referring to FIG. 9, hanger assembly 10 has central through bore 20 and downwardly-facing landing shoulder 15. Elongated recess 70 is disposed along the exterior surface of hanger assembly 10. Alignment/anti-rotation tab member 40 is moveably disposed within said elongated recess 70. Alignment/anti-rotation tab member 40 has elongated slot 42 and transverse bore 41. Alignment bolt 60 having head 61 and alignment bolt 62 having head 63 are disposed through said elongated slot 42 and are partially received within threaded bores 71 in hanger assembly 10. Set screw 50 is received within transverse bore 41 of alignment/anti-rotation tab member 40.

When set screw 50 is sufficiently loosened, alignment/anti-rotation tab member 40 is permitted to slidably move within said elongated recess 70. In that case, it is to be observed that alignment bolts 60 and 62 cooperate with elongated slot 42 to ensure that any such travel is exclusively linear and in alignment with the longitudinal axis of elongated recess 70. Further, bolt heads 61 and 63 cooperate with alignment/anti-rotation tab member 40 to ensure that said alignment/anti-rotation tab member 40 remains within said elongated recess 70 and in contact with hanger assembly 10.

In the embodiment depicted in FIG. 9, alignment/anti-rotation tab member 40 is in a retracted position within elongated recess 70 in hanger assembly 10. In this configuration, said alignment/anti-rotation tab member 40 does not extend beyond landing shoulder 15 of hanger 10. Set screw 50 can be tightened in order to "lock" said alignment/anti-rotation tab member 40 in this position and against slidable movement within elongated recess 70.

Figure 10:
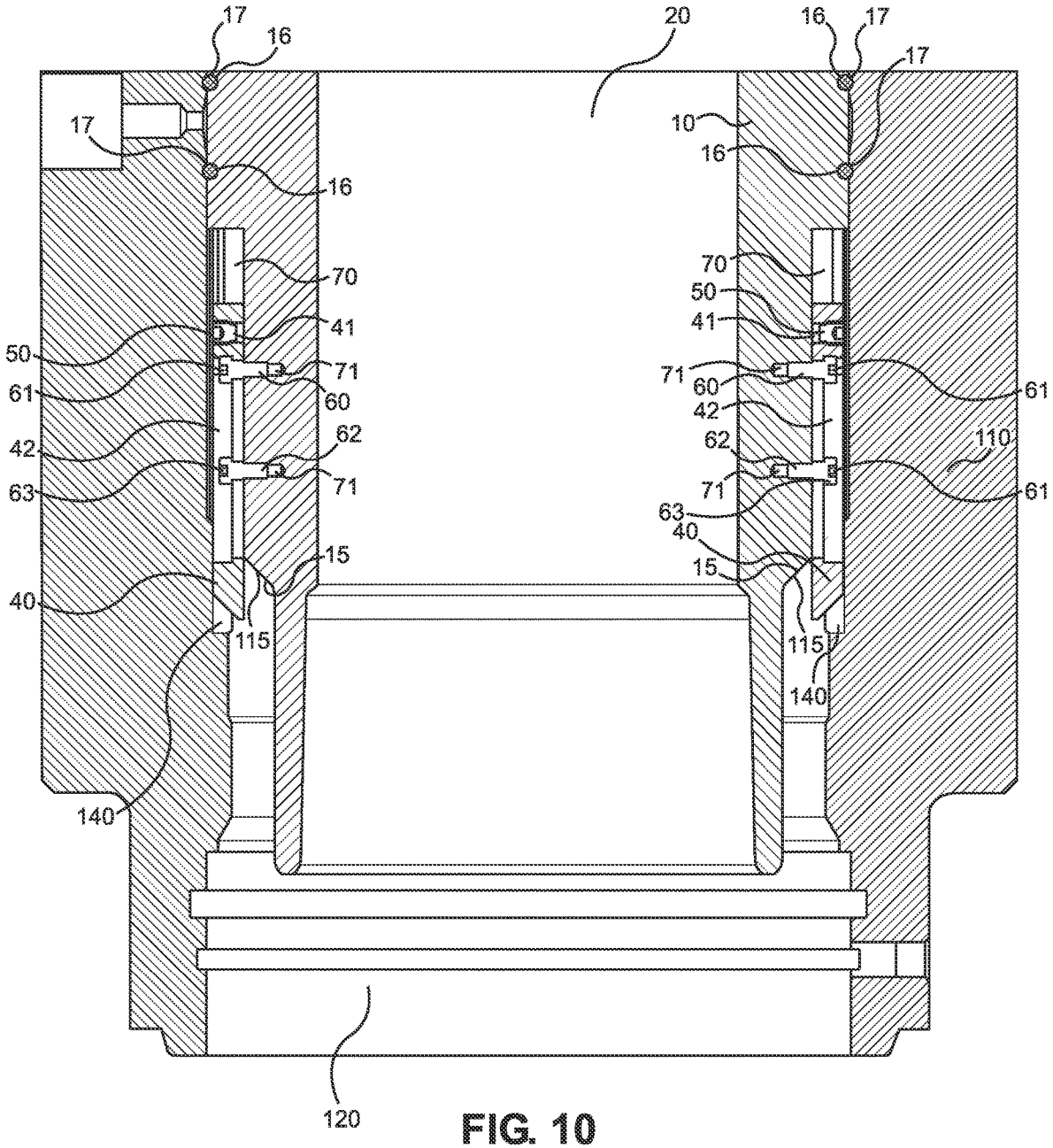
FIG. 10 depicts a side sectional view of a hanger assembly of the present invention within a wellhead with alignment/anti-rotation tab members in an extended configuration.
Figure 11:
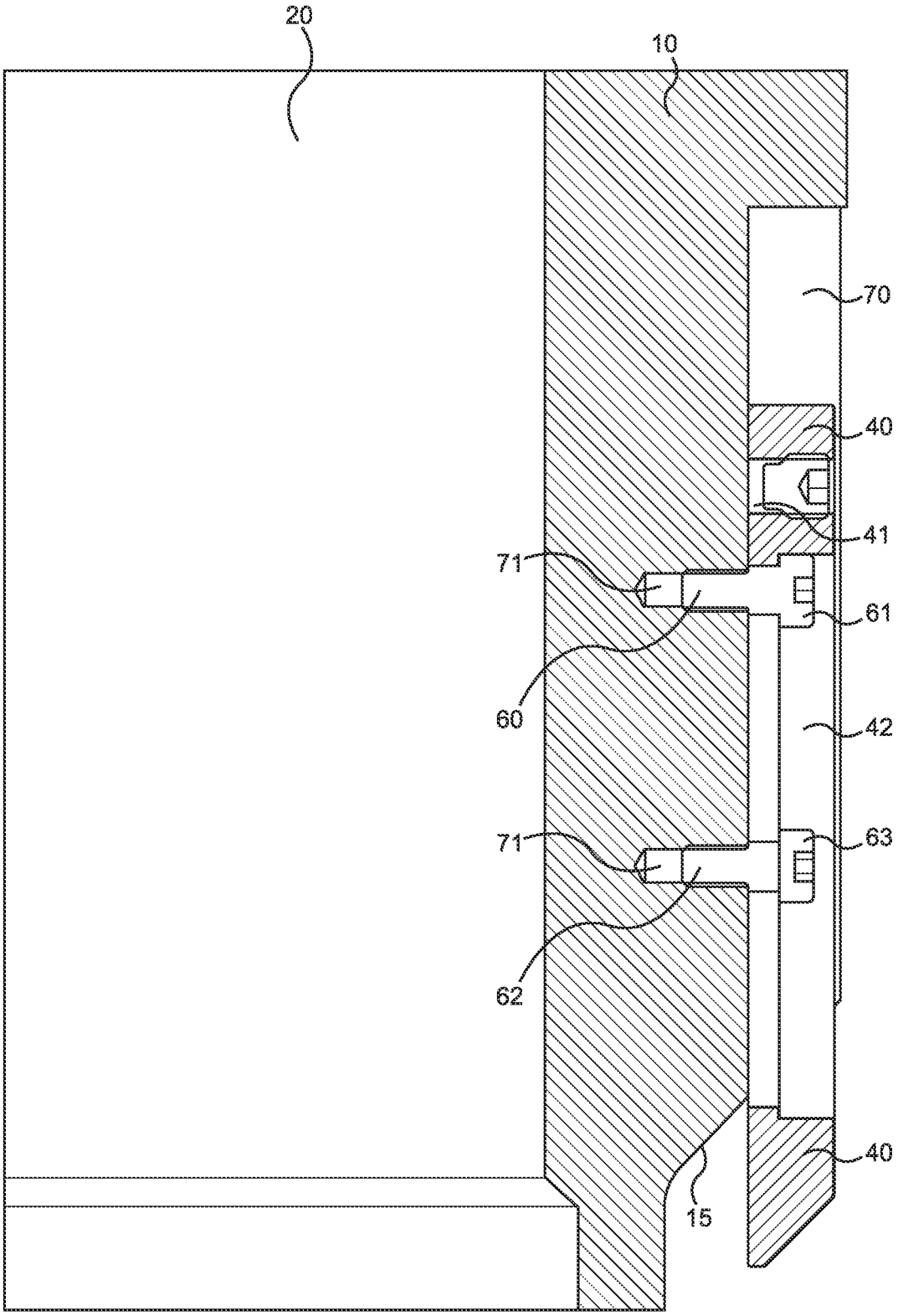
FIG. 11 depicts a side sectional and detailed view of an alignment/anti-rotation tab member in a retracted configuration.

FIG. 10 depicts a side sectional view of a hanger assembly 10 of the present invention installed within a wellhead 110, while FIG. 11 depicts a detailed side sectional view of an alignment/anti-rotation tab member 40 of said hanger assembly 10. Referring to FIG. 10, hanger assembly 10 having central through bore 20 is received within central through bore 120 of wellhead 110. Hanger assembly 10 has downwardly-facing landing shoulder 15 that engages against opposing shoulder 115 which is disposed on the inner surface of central through bore 120 of wellhead 110. Landing shoulder 15 and opposing shoulder 115 cooperate to support hanger assembly 10 (and any attached pipe string) when said hanger assembly 10 is landed within central through bore 120 of wellhead 110.

Grooves 16 are disposed along the outer surface of hanger assembly 10 for receiving O-rings or other elastomeric sealing members 17. Said O-rings or other elastomeric sealing members 17 engage against inner surface 121 of central through bore 120 of wellhead 110 to form a fluid pressure seal between hanger assembly 10 and wellhead 110.

Each alignment/anti-rotation tab member 40 is disposed within an elongated recess 70 and has elongated slot 42 and transverse bore 41. Alignment bolt 60 having head 61, and alignment bolt 62 having head 63, are disposed through said elongated slots 42 and threadedly connected to hanger assembly 10 in threaded bores 71. Set screw 50 is received within each transverse bore 41 of each alignment/anti-rotation tab member 40. In the configuration depicted in FIG. 10, said alignment/anti-rotation tab members 40 are aligned with slots 140 formed along the inner surface of central through bore 120 of wellhead 110. Further, in the configuration depicted in FIG. 10, alignment/anti-rotation tab members 40 are in an extended position within elongated recesses 70 in hanger assembly 10; in this position, said alignment/anti-rotation tab members 40 extend beyond landing shoulder 15 and are received within slots 140 in the inner surface of central through bore 120 of wellhead 110.

Referring to FIG. 11, elongated recess 70 is disposed along the exterior surface of hanger assembly 10. Alignment/anti-rotation tab member 40 is moveably disposed within said elongated recess 70. Alignment/anti-rotation tab member 40 has elongated slot 42 and transverse bore 41. Alignment bolt 60 having head 61 and alignment bolt 62 having head 63 are disposed through said elongated slot 42 and are partially received within threaded bores 71 in elongated recess 70 of hanger assembly 10. Set screw 50 is received within transverse bore 41 of alignment/anti-rotation tab member 40.

In the configuration depicted in FIG. 11, alignment/anti-rotation tab member 40 is in an extended position within elongated recess 70 in hanger assembly 10. In this configuration, said alignment/anti-rotation tab member 40 extends beyond downwardly-facing landing shoulder 15 of hanger 10. Alignment bolts 60, each having head 61, limit downward travel of each alignment/anti-rotation tab member 40 within an elongated recess 70. Set screw 50 can also be selectively tightened in order to "lock" said alignment/anti-rotation tab member 40 in this position. As previously noted, alignment bolts 60 and 62 cooperate with elongated slot 42 to ensure that travel of each alignment/anti-rotation tab member 40 is exclusively linear and in alignment with the longitudinal axis of elongated recess 70. Further, bolt heads 61 and 63 cooperate with each alignment/anti-rotation tab member 40 to ensure that said alignment/anti-rotation tab member 40 remains within said elongated recess 70 and in contact against hanger assembly 10.

Figure 12:
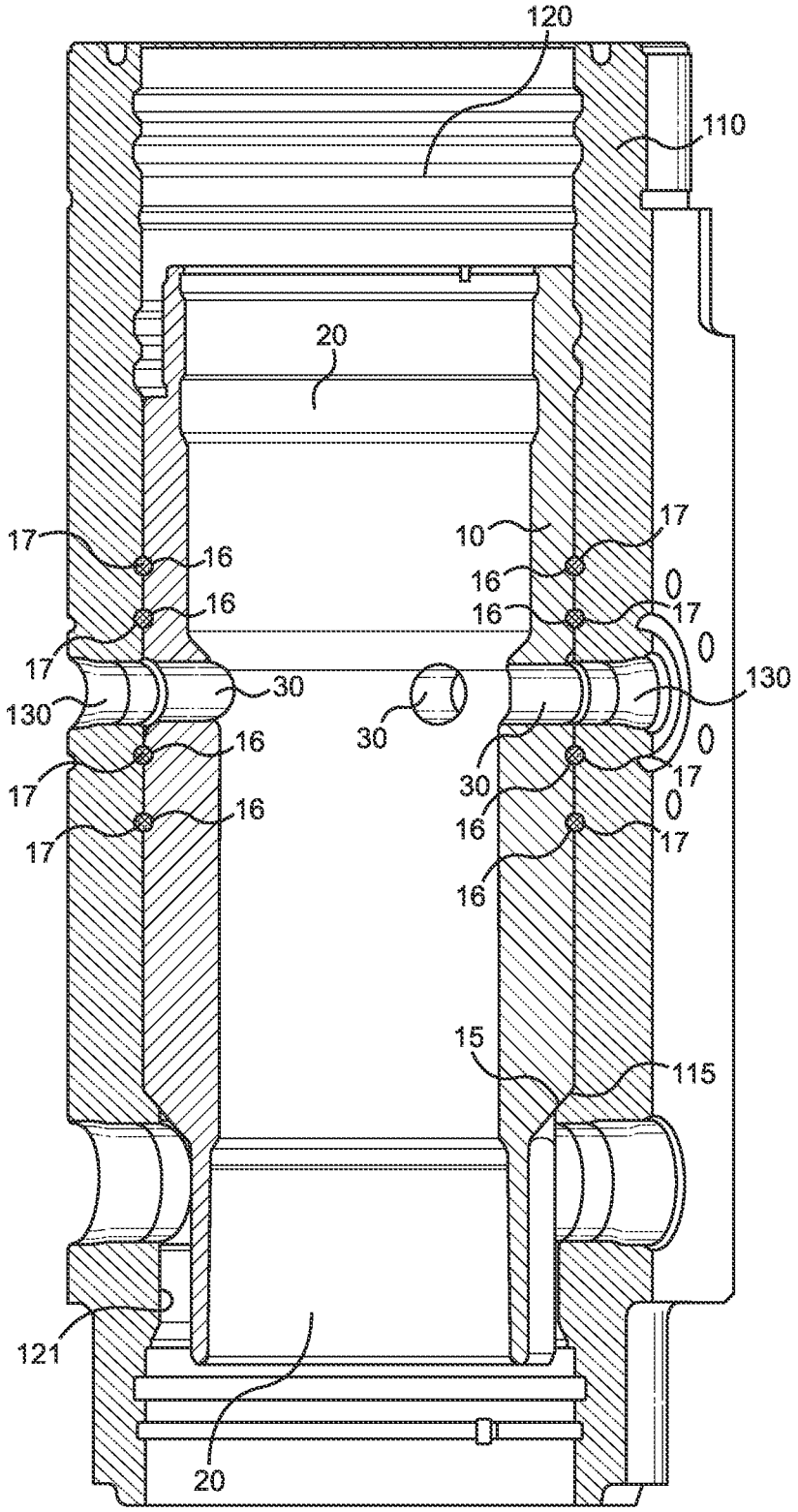
FIG. 12 depicts a side perspective cut-away view of a hanger assembly of the present invention landed within a mating wellhead.

FIG. 12 depicts a side perspective cut-away view of a hanger assembly 10 of the present invention deployed within a wellhead 110. Hanger assembly 10 has central through bore 20 and is received within central through bore 120 of wellhead 110; hanger assembly 10 has downwardly-facing landing shoulder 15 that engages against opposing upwardly-facing shoulder 115 which is disposed on the inner surface of central through bore 120 of wellhead 110. Landing shoulder 15 and opposing shoulder 115 cooperate to support hanger assembly 10 (and any attached pipe string) when said hanger assembly 10 is landed within central through bore 120 of wellhead 110. Although not visible in FIG. 12, it is to be understood that alignment/anti-rotation tab members 40 are in an extended position within elongated recesses 70 in hanger assembly 10 and extend into slots 140 in wellhead 110. In the extended position, said alignment/anti-rotation tab members 40 align hanger assembly 10 within wellhead 110, and prevent rotation of said hanger assembly 10 within said wellhead 110.

A plurality of transverse ports 30 extend through hanger assembly 10 and are aligned with transverse ports 130 extending through wellhead 110 when hanger assembly 10 is fully received, landed and property aligned within central through bore 120 of wellhead 110. Grooves 16 are disposed along the outer surface of hanger assembly 10 for receiving O-rings or other elastomeric sealing members 17. Said sealing members 17 disposed within grooves 16 can engage against the inner surface 121 of said central through bore 120 of wellhead 110 to form a fluid pressure seal between said hanger assembly 10 and said wellhead 110.

In operation, referring to FIG. 4, a hanger assembly 10 is equipped with at least one alignment/anti-rotation tab member 40. Each such alignment/anti-rotation tab member 40 is movably disposed within an elongated recess 70 formed along the outer surface of said hanger assembly 10. During storage or transportation of said hanger assembly 10, each alignment/anti-rotation tab member 40 can be positioned in a retracted configuration, wherein said alignment/anti-rotation tab members 40 do not extend beyond downwardly-facing landing shoulder 15 of hanger assembly 10. Set screws 50 can be tightened to secure said alignment/anti-rotation tab members 40 against inadvertent movement.

Prior to landing said hanger assembly 10 within the central through bore of a wellhead (such as wellhead 110), said set screws 50 can be selectively loosened in order to permit said alignment/anti-rotation tab members 40 to move within said elongated recesses 70. Referring to FIGS. 6 and 7, said alignment/anti-rotation tab members 40 can be selectively shifted so that they are positioned in an extended configuration, wherein said alignment/anti-rotation tab members 40 extend beyond downwardly-facing landing shoulder 15 of hanger assembly 10. In this configuration, bolts 60 limit travel of said alignment/anti-rotation tab members 40 within said elongated recesses 70. Set screws 50 can be selectively tightened to secure said alignment/anti-rotation tab members 40 in said configuration.

Referring to FIG. 10, when said alignment/anti-rotation tab members 40 are in an extended configuration during landing of hanger assembly 10 within central through bore 120 of wellhead 110, said extended alignment/anti-rotation tab members 40 can be aligned with slots 140 formed along the inner surface of central through bore 120 of wellhead 110. In this configuration, said alignment/anti-rotation tab members 40 extend beyond landing shoulder 15 of hanger assembly 10 and are received within said slots 140 in the inner surface of central through bore 120 of wellhead 110, while downwardly-facing shoulder 15 of hanger assembly 10 is landed on opposing upwardly-facing support shoulder 115 of wellhead 110. In this configuration, said alignment/anti-rotation tab members 40 cooperate with slots 140 to align said hanger assembly 10 in a desired radial orientation along the inner surface of said central through bore 120 of said wellhead 110. Further, said alignment/anti-rotation tab members 40 cooperate with slots 140 to prevent rotation or radial movement of said hanger assembly 10 within said central through bore 120 of wellhead 110 (such as around the longitudinal axis of central through bore 20 of hanger assembly 10). Further still, said alignment/anti-rotation tab members 40 cooperate with slots 140 to orient and align transverse ports 30 of hanger assembly 10 with transverse ports 130 of wellhead 110.

In a preferred embodiment, the preset invention comprises a hanger assembly having the ability to align and orient transverse port(s) in said hanger assembly with port(s) in a surrounding wellhead. The present invention increases the ability to produce fluid(s) from the wellbore through said hanger assembly and aligned outlet port(s) in said hanger assembly and surrounding wellhead without flow restriction. The alignment of said port(s) in the hanger assembly and said wellhead reduces the potential for damage to the hanger and wellhead from fluid erosion. The present invention further permits the production of fluids in a timely manner, thereby eliminating the need for unnecessary downtime for repair or replacement, while increasing production and revenues.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An alignment and anti-rotation apparatus for a hanger and wellhead comprising:

a) a hanger having a central through bore, an external surface, a landing shoulder disposed on said external surface, and at least one elongated channel disposed on said external surface of said hanger, wherein said at least one elongated channel is oriented parallel to a longitudinal axis of said central through bore of said hanger;

b) at least one tab member disposed within said at least one elongated channel, wherein said tab member is configured to selectively alternate between a first retracted position and a second extended position, wherein said at least one tab member extends beyond said landing shoulder of said hanger in said second extended position; and c) a wellhead having a central through bore defining an inner surface, further comprising an opposing landing shoulder configured to receive said landing shoulder of said hanger, and at least one elongated slot disposed in said inner surface, wherein said at least one elongated slot is oriented parallel to a longitudinal axis of said central through bore of said wellhead.

2. The apparatus of claim 1, wherein said at least one tab member is received within said at least one elongated slot of said wellhead in said second extended position.

3. The apparatus of claim 2, wherein said at least one tab member and said at least one elongated slot of said wellhead cooperate to align said hanger within said wellhead.

4. The apparatus of claim 2, wherein said at least one tab member and said at least one elongated slot of said wellhead cooperate to align said hanger in a desired orientation along the inner surface of said central through bore of said wellhead.

5. The apparatus of claim 2, wherein said at least one tab member and said at least one elongated slot of said wellhead cooperate to prevent rotation of said hanger relative to said wellhead.

6. The apparatus of claim 2, further comprising:

a) at least one transverse port extending through said hanger; and b) at least one transverse port extending through said wellhead.

7. The apparatus of claim 6, wherein said at least one tab member and said at least one elongated slot of said wellhead cooperate to align said at least one transverse port extending through said hanger with said at least one transverse port extending through said wellhead.

8. An alignment and anti-rotation apparatus for a hanger and wellhead comprising:

a) a hanger having a central through bore, an external surface, a landing shoulder disposed on said external surface, at least one transverse port extending from said external surface to said central through bore, and at least one elongated channel disposed on said external surface, wherein said at least one elongated channel is oriented parallel to the longitudinal axis of said central through bore of said hanger;

b) a wellhead having a central through bore defining an inner surface, further comprising an opposing landing shoulder configured to receive said landing shoulder of said hanger, at least one transverse port extending from an external surface of said wellhead to said central through bore of said wellhead, and at least one elongated slot disposed in said inner surface of said wellhead, wherein said at least one elongated slot is oriented parallel to a longitudinal axis of said central through bore of said wellhead; and c) at least one tab member movably disposed within said at least one elongated channel of said hanger, wherein said tab member is configured to selectively alternate between a first retracted position and a second extended position, and wherein said at least one tab member extends beyond said landing shoulder of said hanger and is received within said at least one elongated slot of said wellhead in said second extended position.

9. The apparatus of claim 8, wherein said at least one tab member and said at least one elongated slot of said wellhead cooperate to align said at least one transverse port of said hanger within said at least one transverse port of said wellhead.

10. The apparatus of claim 8, wherein said at least one tab member and said at least one elongated slot of said wellhead cooperate to prevent rotation of said hanger relative to said wellhead.

11. A method for aligning a hanger within a wellbore comprising:

a) providing a hanger having a central through bore, an external surface, a landing shoulder disposed on said external surface, at least one elongated channel disposed on said external surface, and at least one tab member disposed within said at least one elongated channel, wherein said at least one elongated channel is oriented parallel to a longitudinal axis of said central through bore of said hanger, and said at least one tab member is configured to selectively alternate between a first retracted position and a second extended position:

b) providing a wellhead having a central through bore defining an inner surface, further comprising an opposing landing shoulder and at least one elongated slot disposed in said inner surface of said central through bore, wherein said at least one elongated slot is oriented parallel to a longitudinal axis of said central through bore of said wellhead;

c) selectively shifting said at least one tab member from said first retracted position to said second extended position, wherein said at least one tab member extends beyond said landing shoulder of said hanger in said second extended position;

d) landing said hanger within said central through bore of said wellhead; and e) receiving said at least one tab member within said at least one elongated slot of said wellhead.

12. The method of claim 11, wherein said at least one tab member and said at least one elongated slot of said wellhead cooperate to align said hanger in a desired orientation along the inner surface of said central through bore of said wellhead.

13. The method of claim 11, wherein said at least one tab member and said at least one elongated slot of said wellhead cooperate to prevent rotation of said hanger relative to said wellhead.

14. The method of 11, further comprising:

a) at least one transverse port extending through said hanger; and b) at least one transverse port extending through said wellhead.

15. The method of claim 14, wherein said at least one tab member and said at least one elongated slot of said wellhead cooperate to align said at least one transverse port extending through said hanger with said at least one transverse port extending through said wellhead.

* * * * *